US005176613A

United States Patent [19]

Cavlin et al.

[11] Patent Number: 5,176,613

[45] Date of Patent: Jan. 5, 1993

[54] PROCESS AND AN APPARATUS FOR DIE-CUTTING OF PACKAGING MATERIAL

[76] Inventors: Sören Cavlin, Alvägen 21, S-183 63 Täby; Birger Edholm, Bäckgardsvägen 3, S-143 00 Vårby, both of Sweden

[21] Appl. No.: 720,792

[22] PCT Filed: Jan. 17, 1990

[86] PCT No.: PCT/SE90/00040

§ 371 Date: Jul. 5, 1991

§ 102(e) Date: Jul. 5, 1991

[87] PCT Pub. No.: WO90/08018

PCT Pub. Date: Jul. 26, 1990

[30] Foreign Application Priority Data

Jan. 20, 1989 [SE] Sweden ..... 8900209

[51] Int. Cl.[5] ..... B26F 1/00; B31B 1/14

[52] U.S. Cl. ..... 493/354; 83/55; 83/862

[58] Field of Search ..... 83/55, 651, 658, 697, 83/862, 879, 880; 493/354, 355, 396; 76/107.8

[56] References Cited

U.S. PATENT DOCUMENTS

| | | | |
|---|---|---|---|
| 1,080,759 | 12/1913 | Gruenberg | 493/354 |
| 1,082,985 | 12/1913 | Wilder | 83/55 X |
| 2,586,744 | 2/1952 | Truth | 493/354 |
| 3,020,809 | 2/1962 | Guyer et al. | 493/354 |
| 3,735,674 | 5/1973 | Haddock | 493/354 |
| 4,856,393 | 8/1989 | Braddon | 83/55 X |

FOREIGN PATENT DOCUMENTS 1398727 6/1975 United Kingdom .

*Primary Examiner*—Frank T. Yost
*Assistant Examiner*—Eugenia A. Jones
*Attorney, Agent, or Firm*—Burns, Doane, Swecker & Mathis

[57] ABSTRACT

A process and an apparatus for preventing a packaging material which is being die-cut and scored from developing cracks. A crack-reducing sheet material (17) is positioned between the cutting/scoring tools (9, 13) and the packaging material (5) to absorb impact energy from said tools and relieve the packaging material of crackproducing forces in the direction of its plane.

11 Claims, 1 Drawing Sheet

PROCESS AND AN APPARATUS FOR DIE-CUTTING OF PACKAGING MATERIAL

TECHNICAL AREA

The present invention relates to a process and an apparatus for die-cutting and scoring by means of cutting knives and/or scoring rules, of at least substantially flat packaging material which, when being die-cut and scored, has a tendency to crack in the direction of its plane at or near the places where the cutting knives and/or the scoring rules are brought into contact with the packaging material. In the context of the present invention, the term "packaging material" should be broadly interpreted to comprise also display material, for instance, the invention is especially concerned with sheet or strip material, preferably of the type corrugated paperboard or cardboard, and especially laminated material.

TECHNICAL BACKGROUND

In conventional die-cutting and scoring of packaging material, cutting knives and/or scoring rules disposed in a punch are thrust at high speed directly against the unprotected packaging material which is squeezed between the die-cutting/scoring tools and an anvil consisting of either a flat plate (planar die-cutting and scoring) or a rotating cylinder (rotary cutting and scoring). In the latter case, also the cutting/scoring tools are disposed on a rotating cylinder. The cutting knives produce a complete penetration of the packaging material, i.e. a division thereof, whereas the scoring rules which do not penetrate the packaging material completely, produce a permanent deformation and a weakening of the flexural rigidity, i.e. fold lines. Crack-producing forces arise in the packaging material in the direction of its plane, both where complete and incomplete penetration occurs. With present-day technique, these forces often are the cause of an annoying formation of cracks, so that higher grammage, greater strength or thickness of the packaging material is required than would otherwise be necessary. The risk of crack formation increases production costs and restricts the construction possibilities of the packages. In extreme cases, die-cutting and scoring techniques cannot be used at all.

OBJECT OF THE INVENTION

The object of the present invention is to improve upon prior art technique in a simple and inexpensive fashion, such that crack formation, at least to a substantial degree, is prevented.

SUMMARY OF THE INVENTION

According to the invention, this is achieved by a process and an apparatus having the distinctive features stated in the appended claims.

The invention is based on the insight that crack-producing forces which arise to a critical degree the moment the cutting knives and/or the scoring rules come into contact with the packaging material, i.e. when the deformation begins, and in other words impact energy can be absorbed by an intermediate material, such that a crack-reducing effect is obtained in that the packaging material is relieved in the direction of its plane. The crack-reducing material will have the direct contact with the cutting knives and/or scoring rules and thus eliminate the risk that dangerous stress concentrations are produced in the packaging material. It has been found that practically all formation of cracks in the packaging material can be prevented in this way.

It has been found that the choice of crack-reducing material is not critical, the main thing being that the material has such properties that it can absorb impact energy and forces in the direction of its plane, i.e. take up impacts in this plane, at the same time as it does not adversely affect the requisite deformation. The material should be in sheet form and have a certain amount of tensile stiffness and flexural rigidity, and it may advantageously be comparatively thin (foil or film) and thus inexpensive. Usable materials are, for example, paper, plastic and woven material.

Practical tests have now surprisingly shown that the crack-reducing effect is not to any substantial degree impaired if a cutting knife, when executing a cutting movement, passes through a slit in the material, made by a previous cutting movement. This means that one and the same crack-reducing material can be used repeatedly, which saves costs and also affords constructional advantages.

During the cutting and scoring operation, the crack-reducing material should be applied against the packaging material at least at the places where the cutting knives and/or scoring rules make contact with the material. The crack-reducing material should be kept at least substantially stretched over the packaging material.

It is not necessary to arrange the crack-reducing material over the entire packaging material; it suffices that the material covers at least the areas adjoining the places where the cutting knives and/or scoring rules come into contact with the material and where substantial crack formation can be expected. Thus, it is especially suitable to arrange the crack-reducing material at least over an area where a cutting knife and adjacent scoring rules situated on both sides thereof operate.

The crack-reducing material can be fixed to a punch, preferably to resilient fasteners provided on the punch. At least some of these fasteners can be conventional resilient ejectors.

It is also possible to apply the crack-reducing material against the surface of the packaging material, and to fix or hole it thereagainst in some suitable manner, before the material is introduced into the apparatus, or, alternatively, thereafter.

When the crack-reducing material is placed directly on the surface of the packaging material, one may find it expedient, in order to ensure that the crack-reducing material stays in position during the cutting and scoring operation, to utilise the clamping effect provided by, for example, the resilient ejectors disposed on the punch and bearing against the crack-reducing material and the underlying packaging material.

The crack-reducing effect of the invention is especially pronounced with packaging material of corrugated paperboard, and it has been possible to cut and score, without any crack formation problems whatsoever, also such corrugated paperboard that has a facing containing a considerable amount of recycled fibres.

In the following, the invention, and embodiments thereof, will be described in more detail, reference being had to the accompanying drawings.

DESCRIPTION OF EMBODIMENTS

Figure 1:
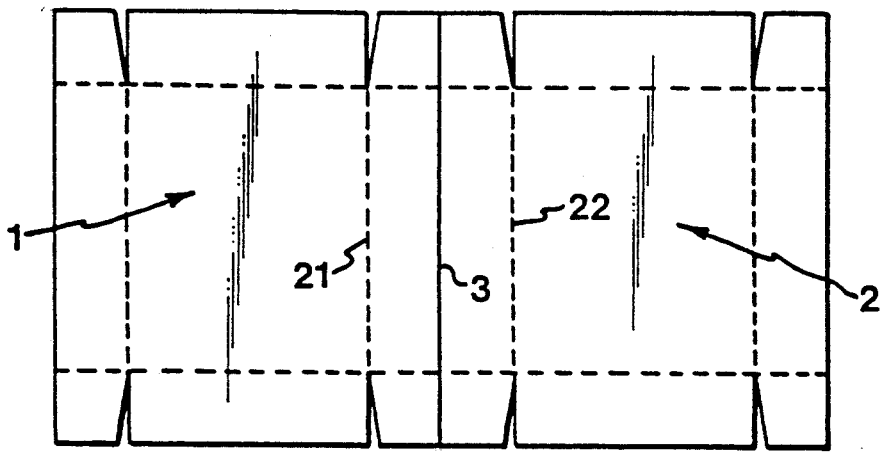
FIG. 1 is a plan view of a cut and scored packaging material comprising blanks for two identical packages.

FIG. 1 shows a typical example of a cut and scored packaging material comprising two identical blanks 1 and 2 separated from each other by the cut 3. In FIG. 1, the cuts made by the cutting knives are shown with full lines, whereas the fold lines (score lines) are represented by dashed lines. Naturally, the outer boundary lines of the blanks are cuts.

Figure 2:
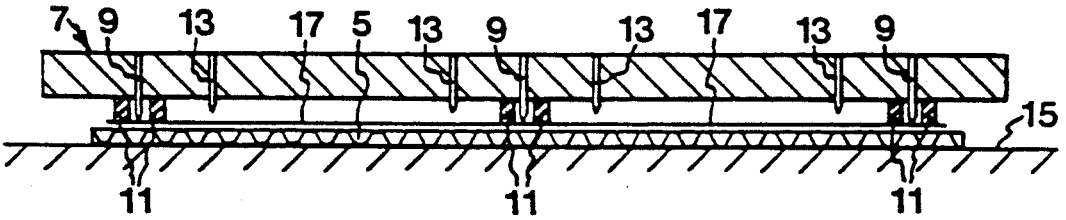
FIG. 2 is a schematic central sectional view of a cutting/scoring apparatus provided with the crack-reducing material according to the present invention, the apparatus being ready to cut and score a packaging material introduced therein, so as to produce the cut and scored packaging material in FIG. 1.
Figure 3:
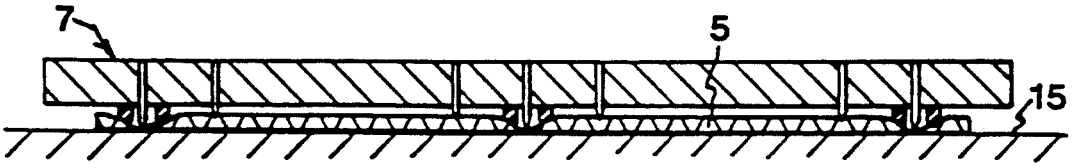
FIG. 3 is a view similar to FIG. 2, showing the punch of the apparatus in its operating position.

The packaging material shown in FIG. 1 has been cut and scored in an apparatus shown in FIGS. 2 and 3 from a starting material 5 in sheet form, which on all sides is slightly larger than the finished packaging material 1, 2. In conventional manner, the apparatus comprises a punch or die form 7 with cutting knives 9 which on both sides have conventional resilient ejector elements 11, so-called rubber ejectors, and scoring rules 13. As is apparent from FIG. 2, the blunt scoring rules 13 do not project as far as the knives 9 which are provided with cutting edges. The end surfaces of the ejectors 11 are situated in a plane somewhat outside a plane containing the cutting edges of the knives 9. It is appreciated that the cutting knives 9 and the scoring rules 13 are arranged in a pattern corresponding to the pattern of cuts and fold lines in FIG. 1.

Furthermore, the apparatus comprises a conventional anvil plate 15 on which the packaging material 5 is placed in order to be cut and scored, as well as conventional means (not shown) adapted to push the punch 7 against the plate 15.

In view of the entirely conventional design of the apparatus in these respects, a more detailed description of the component parts is uncalled for.

According to the invention, a crack-reducing material 17 in sheet form is arranged on the punch 7, substantially parallel to the plate 15, said material covering all the cutting knives 9 and scoring rules 13. In other words, practically the entire surface of the packaging material 5 (with the exception of a minor, circumferential edge area) is covered by the crack-reducing material 17 when the cutting and scoring operation is carried out (FIG. 3). The material 17 is mounted on, i.e. attached to, the end surfaces of the ejectors 11, such that the material is substantially stretched, preferably with a certain tension. It is appreciated that by placing the crack-reducing material 17 "outside" ("beneath" in the FIG.) the cutting knives 9 and scoring rules 13, the material will be applied against the surface of the packaging material 5 before the cutting knives 9 and scoring rules 13 are moved into contact with the packaging material on the anvil plate 15. At the movement of contact, the crack-reducing material 17 absorbs the first impact and thus relieves the packaging material 5 of crack-producing forces.

The crack-reducing material 17 preferably is a thin film, foil or web of plastic material having a typical thickness in the order of 1 mm or less.

As has become apparent, the risk of crack formation is particularly great in the areas where a cut on both sides has adjacent fold lines. In the embodiment according to FIG. 1, these areas are the two areas between the cut 3 and the fold lines 21 and 22. Thus, cracks running essentially parallel to the cut 3 and the lines 21, 22 often arise in the middle of these two areas, i.e. at a certain distance from said cut and the lines.

In such a case, a major crack-reducing effect can be obtained if the crack-reducing material is substantially arranged over these particularly exposed areas only.

Figure 4:
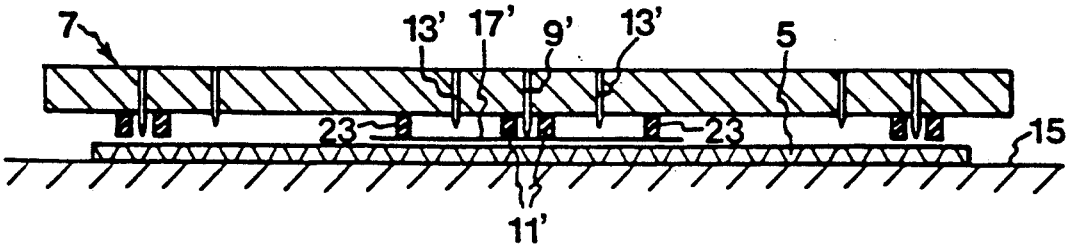
FIG. 4 is a schematic sectional view of an alternative embodiment of the apparatus, the crack-reducing material being arranged to cover only a portion of the packaging material.

This has been applied in a modified embodiment of the apparatus according to the invention, which is shown in FIG. 4. The apparatus is the same as in FIGS. 2 and 3, save that the crack-reducing material 17' here only covers the central area underneath the cutting knife 9' and the scoring rules 13'. In this case as well, the material is stretched between, and attached to, the end surfaces of resilient elements consisting of the rubber ejectors 11' associated with the cutting knife 9', and further fastening rubber members 23 which are made and mounted in the same fashion as the ejectors 11', but which are disposed on the opposite side of the associated scoring rule 13'.

Although the crack-reducing material in this embodiment is affixed to the punch, it could obviously be otherwise arranged, for example, mounted in a frame or the like, the frame being applied over the packaging material, such that the crack-reducing material rests on the packaging material, whereupon the die-cutting and scoring operation is carried out.

We claim:

1. A process for die-cutting and scoring laminated packaging material such as corrugated paperboard comprising the steps of:

arranging a laminated packaging material in a die-cutting and scoring apparatus, said apparatus having cutting knives and scoring rules;

urging said cutting knives and scoring rules against said packaging material through a crack-reducing sheet material arranged between said packaging material and said cutting knives and scoring rules, said crack-reducing sheet material having a predetermined tensile stiffness and flexural rigidity so as to absorb forces and impact energy in a direction along its plane and thereby reduce crack formation in cutting and scoring regions on said laminated packaging material, said crack-reducing sheet material being applied against said packaging material during said urging of said cutting knives and scoring rules so as to cover at least said cutting and scoring regions, while being urged against the packaging material only at localized regions by means of resilient members.

2. A process for die-cutting and scoring laminated packaging material according to claim 1, wherein the cutting knives are urged through slits in the crack-reducing sheet material.

3. A process for die-cutting and scoring laminated packaging material according to claim 1, wherein said crack-reducing material is disposed on said die-cutting and scoring apparatus.

4. A process for die-cutting and scoring laminated packaging material according to claim 1, wherein prior to said urging of said cutting knives and scoring rules, said crack-reducing sheet material is disposed on the surface of said laminated packaging material.

5. A process for die-cutting and scoring laminated packaging material according to claim 3, wherein prior to arranging said laminated packaging material in said die-cutting and scoring apparatus, said crack-reducing material is disposed on said resilient members, said resiliency members being mounted in said die-cutting and scoring apparatus.

6. A process for die-cutting and scoring laminated packaging material according to claim 1, wherein prior to said urging of said cutting knives and scoring rules, said crack-reducing material is placed in a region wherein at least one cutting knife and at least two scoring rules will be urged against said laminated packaging material, said at least two scoring rules being disposed oppositely adjacent said at least one cutting knife.

7. An apparatus for die-cutting and scoring laminated packaging material such as corrugated paperboard comprising:

a press having at least one cutting knife and at least one scoring rule;

an anvil for supporting a laminated packaging material intended for cutting and scoring;

sheet material means for reducing the formation of cracks in cutting and scoring regions of said laminated packaging material, said sheet material means having a predetermined tensile stiffness and flexural rigidity so as to absorb forces and impact energy in a direction of its plane;

said sheet material means being situated between the laminated packaging material and at least one cutting knife and scoring rule during cutting and scoring of said laminated packaging material;

said sheet material means being situated such that said sheet material means is applied to said laminated packaging material during cutting and scoring at least in said cutting and scoring regions;

said sheet material means being provided such that said sheet material means is urged against said laminated packaging material during cutting and scoring, by means of resilient members of said press only at localized regions.

8. An apparatus for die-cutting and scoring laminated packaging according to claim 7, wherein said sheet material means is fixed at least substantially stretched on said press.

9. An apparatus for die-cutting and scoring laminated packaging according to claim 7, wherein said sheet material means is fixed to said press by said resilient members.

10. An apparatus for die-cutting and scoring laminated packaging according to claim 8, wherein said sheet material means is fixed to said press by said resilient members.

11. An apparatus for die-cutting and scoring laminated packaging according to claim 9, wherein said resilient members are resilient ejectors.

* * * * *